United States Patent [19]

Ville et al.

[11] Patent Number: 4,638,759

[45] Date of Patent: Jan. 27, 1987

[54] MAGNETIC BRUSH APPARATUS FOR DEVELOPING ELECTROSTATIC IMAGES

[75] Inventors: Ivan B. Ville, Spencerport; James D. Walling, Fairport; Kevin E. Yousey, Brockport, all of N.Y.

[73] Assignee: Eastman Kodak Company, Rochester, N.Y.

[21] Appl. No.: 744,874

[22] Filed: Jun. 17, 1985

[51] Int. Cl.[4] ..... G03G 15/10

[52] U.S. Cl. ..... 118/657

[58] Field of Search ..... 118/657

[56] References Cited

U.S. PATENT DOCUMENTS 3,909,258 9/1975 Kotz .
4,235,549 11/1980 Eisbein et al. .
4,303,331 12/1981 Thompson .
4,357,103 11/1982 Kroll ..... 118/657 X
4,394,429 7/1983 Hays .

*Primary Examiner*—Bernard D. Pianalto
*Attorney, Agent, or Firm*—Warren W. Kurz

[57] ABSTRACT

A magnetic brush apparatus for use in electrographic copiers and the like for applying magnetic developer to electrostatic images at a development zone to effect development of such images. Such apparatus includes a non-magnetic sleeve having a rotatably driven magnetic roller therein, and magnetic shunt means for selectively reducing the magnetic field produced by the magnetic roller outside the sleeve. By reducing the magnetic field shortly after the developer first contacts the image and maintaining the reduced field until the developed image is advanced beyond the influence of the magnetic roller, a trailing edge development artifact is avoided.

10 Claims, 2 Drawing Figures

MAGNETIC BRUSH APPARATUS FOR DEVELOPING ELECTROSTATIC IMAGES

BACKGROUND OF THE INVENTION

This invention relates to the field of electrography and, more particularly, to magnetic brush development apparatus for applying a magnetically attractive developer to a latent electrostatic image to effect development thereof.

It is known, in the field of electrography, to develop electrostatic images by applying a magnetically-attractive, single-component, electrically conductive developer thereto. Typically, such developer is applied to the electrostatic image-bearing surface by means of a magnetic brush applicator comprising a non-magnetic sleeve having a rotatably driven, multi-pole magnetic core positioned therein. During development, the electrostatic forces associated with the latent image overcome the magnetic attraction between core and developer, causing the developer to selectively deposit in image configuration on the recording element. The attraction of the developer for the electrostatic image results from a charge, of opposite polarity, induced on the developer by the charge image.

In developing electrostatic images with single-component developer, an image defect known as "trailing-edge development" may arise. Such a defect is characterized by a deposition of a small amount of developer in a short region (e.g., 2–4 millimeters in length) beyond the trailing edge of a developed image area. This undesirable deposition of developer occurs after development of the electrostatic image, as the developed image exits from the development zone. At this time, the magnetic developer is still influenced by the rapidly changing magnetic field produced by the rotating magnetic core of the brush applicator, the result being that developer is drawn from within the boundary of the image area and applied to the non-image areas. While this trailing-edge development defect can be minimized by adjusting certain development parameters, e.g., development electrode bias, such an approach has the undesirable effect of altering the sensitometric properties of the development system.

SUMMARY OF THE INVENTION

In view of the foregoing discussion, an object of this invention is to minimize the aforementioned trailing edge development defect in single component, magnetic brush development systems of the type described, without reducing or otherwise altering the sensitometric response of the development system solely for this purpose.

This object is achieved by the provision of a strategically positioned magnetic shunt means which is located between the rotating core of a magnetic brush applicator and the electrostatic image-bearing surface. The effect of this shunt is to reduce or "knock-down" the magnetic field produced by the rotating brush magnets shortly after image development has occurred and to maintain such reduced field until the developed image exits from the development zone. The reduced field has the effect of reducing the tendency for the developer to become displaced from the electrostatic image after being applied thereto.

The invention and its various advantages will become more apparent to those skilled in the art from the ensuing detailed description of preferred embodiments, reference being made to the accompanying drawings.

DETAILED DESCRIPTION OF PREFERRED EMBODIMENTS

Figure 1:
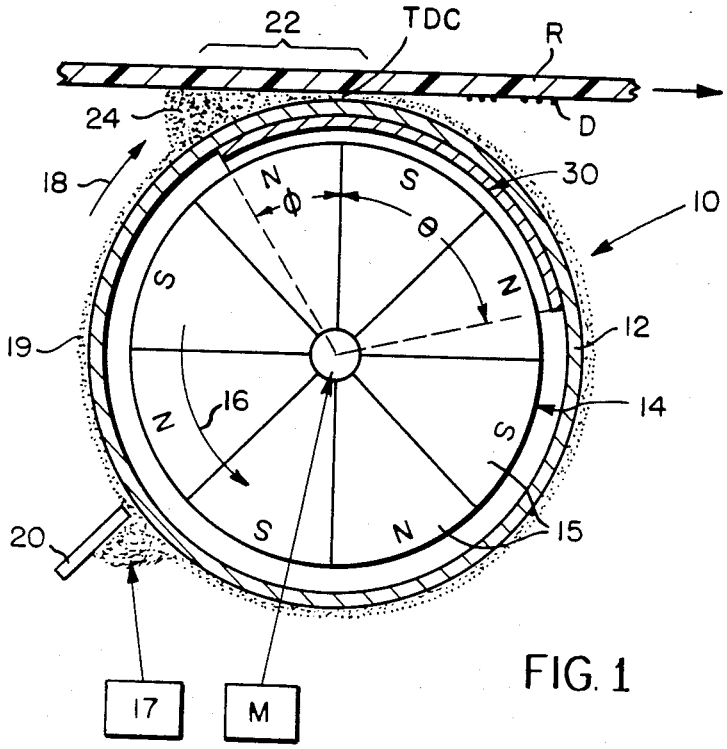
FIG. 1 is a schematic sectional view of a magnetic brush applicator embodying the invention.

Referring now to the drawings, FIG. 1 shows a magnetic brush applicator 10 for applying a single component developer D to an electrostatic image-bearing surface of a recording element R. Magnetic brush applicator 10 comprises a stationary, non-magnetic, cylindrical sleeve 12. Concentrically arranged within the sleeve is a cylindrically shaped, multi-pole, magnetic core 14 comprising a plurality of elongated permanent magnets which alternate in polarity, north-south-north, etc., around the circumference of the core. Motor means M are provided for rotating the core at high speed, e.g. 2000 rpm, in the direction indicated by arrow 16. Developer supply means 17 are provided for supplying the outer surface of sleeve 12 with a fresh supply of electrically conductive and magnetically attractive developer particles. Being magnetically attractive, the developer is drawn to the outer surface of sleeve 12 by the internal magnetic core and, as the internal core rotates counterclockwise, the developer is advanced in a clockwise direction as indicated by arrow 18. The thickness of the developer layer 19 on sleeve 12 is controlled by the position of a skive bar 20 which is adjustable relative to the sleeve's outer surface.

As core 14 rotates, developer is advanced to a development zone 22 where it contacts the electrostatic image on recording element R. Because the developer is advanced at a rate faster than that which can pass between the nip formed between the brush and the recording element, a roll back region 24 is soon established. It is in this region where the developer first contacts and effects development of the electrostatic image. As the developed electrostatic image passes a point directly opposite the recording element (i.e., top-dead-center, TDC) and beyond, there is a tendency for the developer within the image area to be displaced therefrom by the rapidly changing magnetic field produced by the rotating magnets. This movement of the developer results in the aforementioned "trailing edge" defect in image quality. Desirably, once the toner is applied to the image, it should remain unaltered by the brush applicator as it leaves the development zone.

Now in accordance with the present invention, shunt means 30 are provided for selectively reducing the magnetic field from a position just downstream of the leading edge of the development zone through a position in which the developed image is non-affected by the alternating magnetic field produced by the rotating magnets. Magnetic shunt means 30 preferably comprises a strip of magnetically-permeable material, for example, mumetal (a trademark for an alloy comprising approximately Ni 74, Fe 20, Cu 5.3, Cr 2, Mn 0.7%), which is positioned within the sleeve, adjacent the inner surface 12*a* thereof, from an angle $\phi$, measured upstream of top-dead-center, through an angle $\theta$ measured downstream from top-dead-center. Preferably, $\phi$ is between 15 degrees and 40 degrees. It has been experimentally shown that when $\phi$ exceeds 40 degrees, the results are similar to those produced by a magnetic brush of lower magnetic pole strength, and when $\phi$ is less than 15 degrees, undesirable "banding" of the image can occur. The effect of the magnetic shunt 30 is to short circuit magnetic lines of force or flux which, but for the shunt, would penetrate the non-magnetic shell 12 and cause the undesired movement of the developer after image development has taken place. The angle $\phi$ is not critical, so long as it is sufficiently large to prevent magnetic flux from the core from altering the position of the developer after the developer image pass TDC. However, since the shunt does increase the torque requirements of the brush, $\theta$ should be no greater than that required to achieve the above-stated function. It is highly preferred that the shunt length, that is the sum of angles $\phi$ and $\theta$, be sufficient to substantially completely span the outer peripheral portions of at least two adjacent permanent magnets of core 14. Otherwise, some of the lines of force between adjacent pole pieces may still adversely affect the developed image.

Shunts made of mu-metal and steel shim stock were found to perform well. However, any other ferromagnetic material could be used as the shunt material. The thickness of the shunt, of course, depends upon its magnetic permeability and upon the pole strength of the brush magnets. The optimum value is such that the maximum field strength in the development zone at TDC is approximately 150–250 gauss. Shunts thinner than optimum will reduce trailing edge defects but to a lesser extent. Shunts thicker than optimum can result in failure of the developer to flow properly over the brush sleeve's surface. A typical shunt thickness for mu-metal is approximately 0.025 cm.

The invention will be better understood from the following example:

EXAMPLE

A strip of magnetically-permeable mu-metal was bonded to the periphery of a stainless steel brush sleeve having a diameter of 3.2 cm. The dimensions of the mu-metal strip were 0.025 cm. in thickness, 3.2 cm. in width, and 5.0 cm. in length. The leading edge of the strip was positioned at a point on the sleeve approximately 30 degrees before top-dead-center. The trailing edge of the strip was approximately 75 degrees beyond TDC. The recording element/sleeve spacing was set to 0.025 cm. The magnetic field strength of the brush magnets was 1000 gauss. An eight pole magnetic core was rotated at 2000 rpm and the transport speed of the recording element was 25 cm. per second in the direction co-current to the direction of developer transport by the brush.

Images made using this configuration were essentially free of the trailing edge developer defect. Sensitometric tests for this configuration exhibited unexpected results in that instead of the expected increase in contrast and reduced development threshold voltage due to the lower magnetic field strength in the development zone, contrast values were comparable to those attained without the magnetic shunt.

Figure 2:
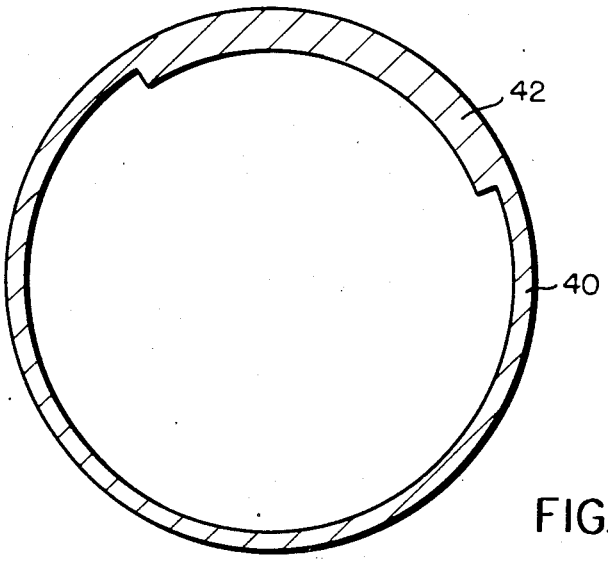
FIG. 2 is a schematic sectional view of a magnetic brush sleeve structured in accordance with an alternative embodiment of the invention.

As an alternative to using a separate magnetic shunt element, the entire brush sleeve could be made of a suitable shunt material, the wall thickness being varied to achieve a desired magnetic field external to the sleeve. In FIG. 2, for example, the brush sleeve 40 is made of a thin mu-metal material which, in the vicinity 42 at which the magnetic field outside the sleeve is to be reduced, the wall thickness is selectively increased. The increased wall thickness, of course, will shunt magnetic flux to a greater extent than the nominal wall thickness, the result being a reduction in magnetic field strength outside the sleeve opposite the thicker wall portion While the invention has been described with particular reference to preferred embodiments, it will be apparent to those skilled in the art that various modifications and changes may be made without departing from the spirit and scope of the invention. For example, the brush applicators described above are of the stationary shell rotating core variety. Obviously, the shell may be allowed to rotate as well, providing the shunt is independently supported in the position described. Other variations, too, will be self-evident to skilled artisans.

We claim:

1. In an electrographic development apparatus for applying a magnetically attractable developer to a latent electrostatic image-bearing surface moving along a path to render such image visible, such apparatus comprising a hollow sleeve positioned adjacent said path to define a nip region at which the outer surface of said sleeve and said image-bearing surface come into contact; a cylindrically-shaped multi-pole magnetic core rotatably mounted within said sleeve, said core comprising a plurality of magnetic pole pieces extending parallel to the core axis around the circumference thereof, said pole pieces alternating in polarity from one to the other and being closely spaced relative to said sleeve so that the magnetic field of said pole pieces extends through and beyond said sleeve; means for supplying magnetically attractable developer to the sleeve surface; and means for rotating said magnetic core to effect movement of the developer over the sleeve surface toward said nip region at which the developer contacts said image-bearing surface and effects development of said latent electrostatic image, the improvement comprising shunt means positioned between said sleeve and said core for reducing the magnetic field produced by said magnetic core outside said sleeve in the vicinity of said nip region, whereby any tendency for the developer to move away from the developed image as such image leaves said nip region is minimized.

2. The apparatus as defined in claim 1 wherein said shunt means co mprises a strip of magnetically permeable material.

3. The apparatus as defined in claim 2 wherein said sleeve is stationary, and wherein said strip is supported by said sleeve and shaped to conform to the sleeve contour.

4. The apparatus as defined in claim 3 wherein the width of said strip, measured along the sleeve circumference, is sufficient to span at least two pole pieces of said magnetic core.

5. The apparatus as defined in claim 4 wherein the one edge of said strip is angularly displaced in a direction upstream from said nip region, and wherein said shunt acts to reduce the magnetic field just downstream of the position at which the developer transported by said sleeve first contacts the image-bearing surface.

6. The apparatus as defined in claim 1 wherein said magnetic shunt means is positioned to reduce the magnetic field from a location downstream of the leading edge of the development zone through a location at which the magnetic field of the core piece can no longer effect movement of the developer on said image-bearing surface.

7. In an electrographic development apparatus for applying a magnetically attractable developer to a latent electrostatic image-bearing surface to render such image visible, such apparatus comprising: a stationary, non magnetic, cylindrical sleeve; a magnetic field-producing core piece rotatably mounted within said sleeve, said sleeve and said core piece being closely spaced so that the magnetic field of said core piece extends through and beyond said sleeve; means for supplying magnetically attractable developer to the outer surface of the sleeve; and means for rotating the core piece to advance such developer over the outer surface of said sleeve, through a development zone at which the developer on said sleeve contacts said surface, the improvement comprising:

means for selectively reducing the strength of said magnetic field at the outer surface of said sleeve in the vicinity of the development zone, said field-reducing means comprising magnetic shunt means positioned between said core piece and said development zone to shunt magnetic lines of force from said core piece before reaching said development zone.

8. The apparatus as defined in claim 7 wherein said magnetic shunt comprises a strip of magnetically permeable material which is supported by said sleeve.

9. The apparatus as defined in claim 8 wherein said material comprises mu-metal.

10. A magnetic brush development apparatus for use in an electrographic copier, said apparatus comprising a stationary hollow sleeve having a rotatably mounted magnetic roller positioned therein, said apparatus being characterized in that the sleeve is made of a magnetically permeable material and, in that the thickness of the sleeve wall is greater in one sector of said sleeve than the nominal thickness of the remaining portion, whereby the magnetic field produced by said magnetic roller outside said sleeve is lower at a location juxtaposed to said sector than at locations juxtaposed said remaining portion.

* * * * *